US007342209B2

(12) United States Patent
Dozier

(10) Patent No.: US 7,342,209 B2
(45) Date of Patent: Mar. 11, 2008

(54) MICROPROCESSOR CONTROLLED TUBE APPARATUS HAVING REDUCED RADIO FREQUENCY EMANATIONS

(75) Inventor: John W. Dozier, Woolwich Township, NJ (US)

(73) Assignee: State Technology, Inc., Bridgeport, NJ (US)

( * ) Notice: Subject to any disclaimer, the term of this patent is extended or adjusted under 35 U.S.C. 154(b) by 0 days.

(21) Appl. No.: 10/919,579

(22) Filed: Aug. 17, 2004

(65) Prior Publication Data

US 2005/0016994 A1 Jan. 27, 2005

Related U.S. Application Data

(62) Division of application No. 10/093,201, filed on Mar. 6, 2002, now Pat. No. 6,794,624.

(51) Int. Cl.
*H05B 6/54* (2006.01)

(52) U.S. Cl. ..... 219/769; 219/777; 219/780; 156/380.3; 156/380.6

(58) Field of Classification Search ..... 219/769–770, 219/777–780, 774, 765; 158/274.4, 48.2, 158/274.6, 274.8, 69, 380.3, 380.4, 380.1, 158/380.2, 380.6, 380.7, 380.8, 381
See application file for complete search history.

(56) References Cited

U.S. PATENT DOCUMENTS 3,742,180 A 6/1973 Bradley
3,992,606 A 11/1976 Arutt et al.
4,013,860 A 3/1977 Hosterman et al.
4,186,292 A 1/1980 Acker
4,355,222 A 10/1982 Geithman et al.
4,362,918 A 12/1982 Rabin
4,384,186 A 5/1983 Burt
4,390,832 A 6/1983 Taylor
4,488,028 A 12/1984 Acker et al.
4,491,711 A 1/1985 Acker
4,496,819 A 1/1985 Acker et al.
4,529,859 A 7/1985 Minney et al.
4,610,670 A 9/1986 Spencer
4,954,678 A 9/1990 Harmony et al.
5,256,845 A 10/1993 Schippers
5,272,304 A 12/1993 Been et al.
5,278,382 A 1/1994 Rische et al.
5,316,124 A * 5/1994 Barnes et al. ..... 194/206
5,345,070 A 9/1994 Hlavinka et al.

(Continued)

OTHER PUBLICATIONS

Sebra, Tube Sealers, 2000.

*Primary Examiner*—Philip H. Leung
(74) *Attorney, Agent, or Firm*—Ratner Prestia

(57) ABSTRACT

A tube apparatus is provided to detect successful or failed tube operations. The tube apparatus includes jaws mounted for movement with respect to one another between (1) a first position spaced from one another and (2) a second position selected to perform a successful tube operation. A sensor is positioned to detect when the jaws have moved into the second position, and a timer is electrically coupled to the sensor for determining the time delay before the jaws have moved into the second position, wherein a time delay up to a predetermined time limit indicates a successful tube operation and a time delay exceeding the predetermined limit indicates a failed tube operation.

40 Claims, 13 Drawing Sheets

U.S. PATENT DOCUMENTS 5,366,580 A 11/1994 Czach
5,374,395 A 12/1994 Robinson et al.
5,710,413 A 1/1998 King et al.
5,750,971 A 5/1998 Taylor
5,831,235 A * 11/1998 Cecil ..... 219/110
5,855,731 A 1/1999 Spencer
6,139,527 A 10/2000 Laufer et al.
6,213,334 B1 4/2001 Coelho et al.
6,583,386 B1 * 6/2003 Ivkovich ..... 219/130.01

* cited by examiner

MICROPROCESSOR CONTROLLED TUBE APPARATUS HAVING REDUCED RADIO FREQUENCY EMANATIONS

This application is a Divisional of U.S. application Ser. No. 10/093,201, filed Mar. 6, 2002 now U.S. Pat. No. 6,794,624.

FIELD OF THE INVENTION

This invention relates to tube apparatus such as tube sealers. More specifically, this invention relates to a microprocessor controlled devices such as dielectric tube apparatus having reduced radio frequency emanations.

BACKGROUND OF THE INVENTION

In a wide variety of applications and industries, there is a need to seal, connect, weld or otherwise manipulate tubes. For example, there is often a need to create a seal at a location along the length of a tube or a portion thereof. Such a seal may be desired to prevent or substantially reduce the flow of gaseous or liquid fluid between adjacent portions of a tube.

One example of an application in which a tube may be desired to be sealed is the sealing of tubes that contain blood or other bodily fluids. For example, blood may be drawn from a donor from flexible tubing that extends into a plastic blood collection bag. Once the bag is filled to its capacity, it may be desired to seal the tubing in order to prevent leakage and/or contamination or deterioration of the collected blood. After such collection, the blood may need to be typed and/or tested under various criteria. In order to provide a representative supply of blood for such typing and test purposes, a plurality of segments of the tubing may be sealed from one another to provide multiple sealed samples. Such samples may later be separately opened for typing and/or testing purposes.

Systems have been proposed to seal tubes using a pair of jaws such as electrodes for compressing tubing while applying radio frequency energy to melt the tubing and form a weld to effect a seal. Such systems generate a substantial quantity of radio frequency (RF) energy in order to heat and melt the plastic of the tubing sufficiently to form a weld. More specifically, a burst of RF energy may be transmitted across the jaws. The tubing represents a resistance to the RF energy transmitted therethrough and a capacitance between the jaws resulting in the development of heat to partially melt or soften the tubing and weld the opposing tubing surfaces to one another.

Radio frequency energy is considered to be electromagnetic energy at any frequency in the radio spectrum between 9 kHz and 3,000,000 MHz. Because of emissions or emanations from devices that generate RF energy, such devices should be constructed in accordance with good engineering design and manufacturing practice. It is also recognized that emanations from such devices should be suppressed as much as practicable. The United States has promulgated regulations to limit the level of emanations from such devices. Reference is made to Chapter 1 of Title 47 of the Code of Federal Regulations.

The foregoing comments apply not only to dielectric tube sealers but also to any apparatus configured to connect, weld, or otherwise manipulate tubes using radio frequency, heat, mechanical elements, or any other known means for manipulating tubes.

SUMMARY OF THE INVENTION

According to one aspect, this invention provides a tube sealer adapted to limit radio frequency emanations during operation. An exemplary embodiment of such a tube sealer may include an enclosure and first and second jaws oriented with respect to the enclosure to receive a tube therebetween. The first jaw is fixed and coupled to a radio frequency generator, and the second jaw is movable with respect to the first jaw and coupled to ground potential. The tube sealer also may include a shield positioned adjacent the enclosure and configured to at least partially enclose the first and second jaws yet permit the introduction of a tube portion to a position between the first and second jaws. The shield thereby reduces radio frequency emanations from the first and second jaws. The shield can be movable with respect to the enclosure to at least partially expose the first and second jaws (e.g., for cleaning and maintenance purposes).

According to another aspect, this invention provides a tube sealer adapted to detect successful or failed seals. One exemplary embodiment of such a tube sealer may include jaws mounted for movement with respect to one another between (1) a first position spaced from one another to receive a tube portion and (2) a second position proximal one another to compress a tube portion, wherein the jaws in the second position define a gap selected to form a successful seal. The tube sealer may also include a sensor positioned to detect when the jaws have moved into the second position. Finally, the tube sealer may further include a timer electrically coupled to the sensor for determining the time delay before the jaws have moved into the second position, wherein a time delay up to a predetermined time limit indicates a successful seal and a time delay exceeding the predetermined time limit indicates a failed seal.

According to yet another aspect, this invention includes a tube sealer that is programmable to control the area of a seal. An exemplary tube sealer according to this aspect of the invention may include a radio frequency generator configured to generate radio frequency for a time period. The tube sealer may also include jaws mounted for movement with respect to one another, one of the jaws being coupled to the radio frequency generator. The tube sealer may also include a microprocessor configured to control the radio frequency generator, wherein the microprocessor is programmable to select the time period during which radio frequency is, generated by the radio frequency generator, thereby controlling the area of the seal formed in a tube.

According to still another aspect, this invention provides a method for controlling the area of a seal formed in a tube by means of a tube sealer having a radio frequency generator and jaws mounted for movement with respect to one another. The method includes the steps of selecting a tube for sealing and programming a microprocessor to select the time period during which the radio frequency is generated, thereby controlling the area of a seal formed in the tube.

BRIEF DESCRIPTION OF THE DRAWING

The invention will described with reference to the exemplary embodiments illustrated in the drawing, of which.

DETAILED DESCRIPTION OF THE INVENTION

Preferred features of exemplary embodiments of this invention will now be described with reference to the figures. It will be appreciated that the spirit and scope of the invention are not limited to the embodiments selected for illustration. Also, it should be noted that the drawings are not rendered to any particular scale or proportion. It is contemplated that any of the configurations and materials described hereafter can be modified within the scope of this invention.

Figure 1A:
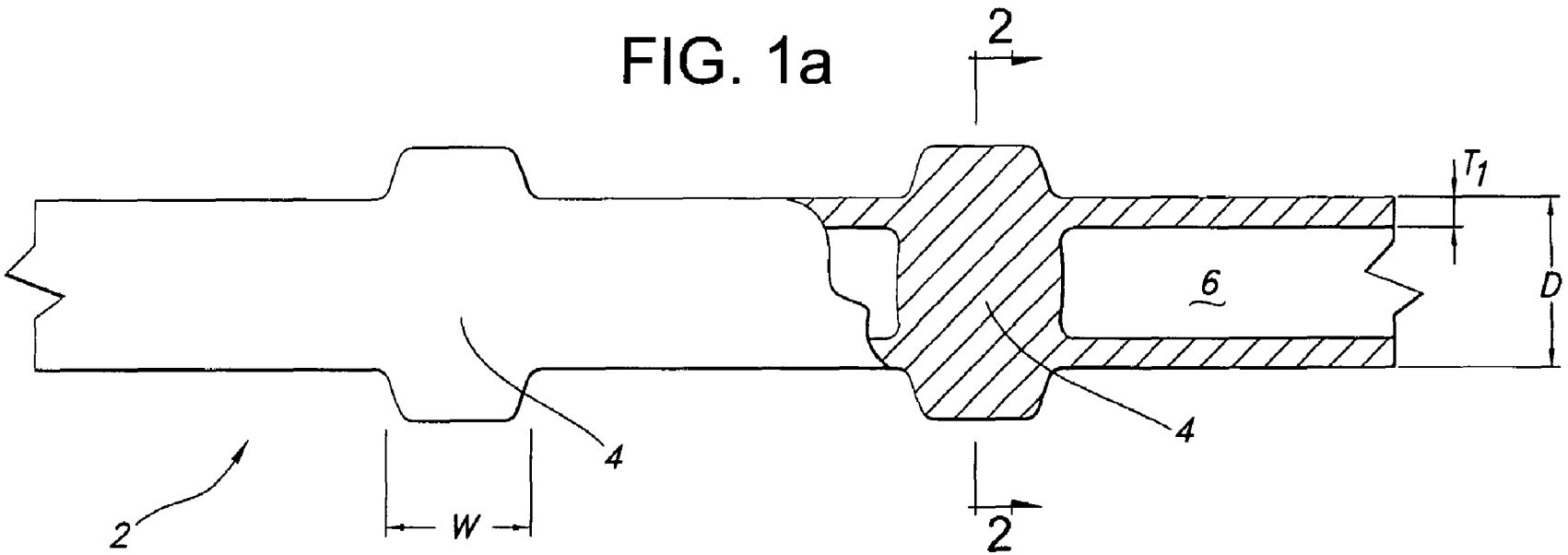
FIGS. 1*a* and 1*b* are front and top views, respectively, of a tube portion sealed according to aspects of this invention.
Figure 2:
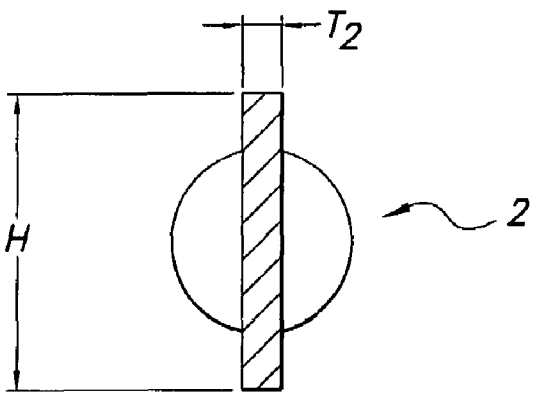
FIG. 2 is a cross-sectional end view of the tube portion illustrated in FIGS. 1*a* and 1*b*.
Figure 1B:
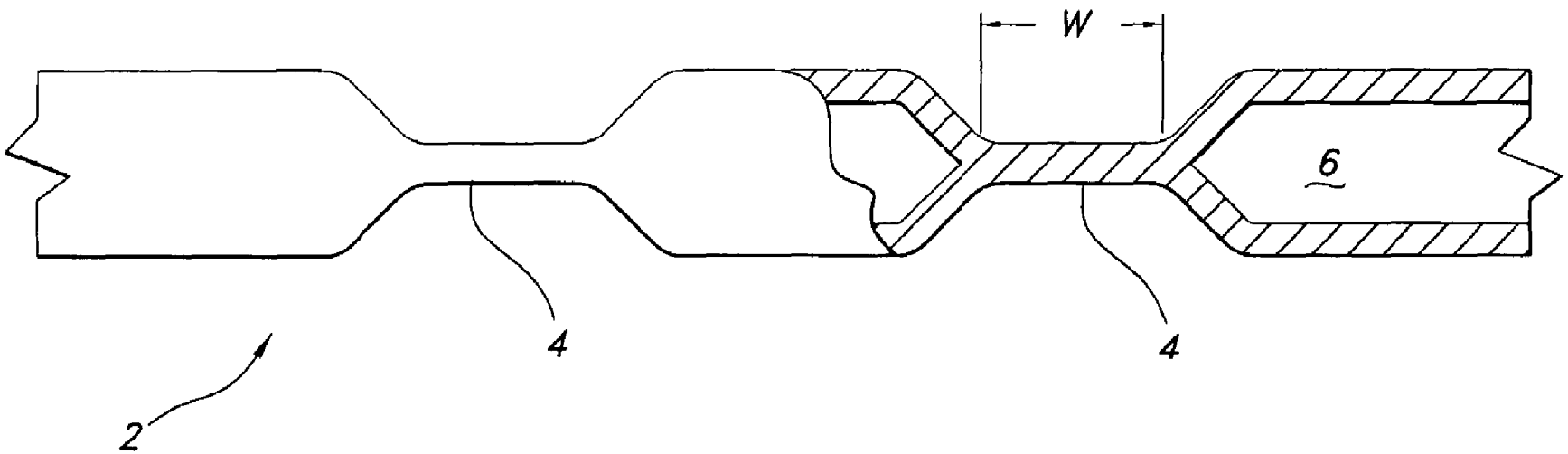
Figure 3:
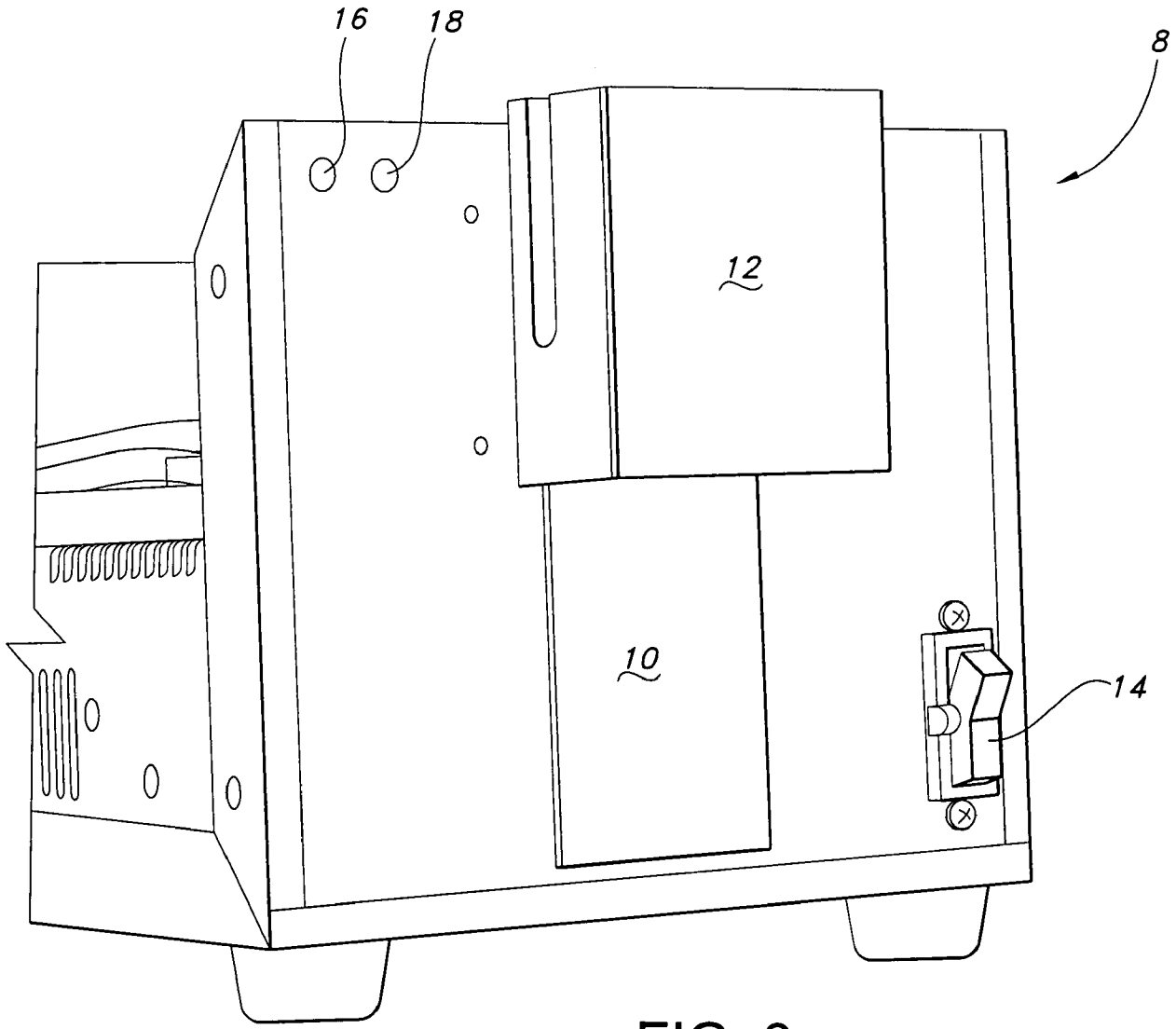
FIG. 3 is a front perspective view of an embodiment of a tube sealer according to aspects of this invention.

Exemplary tube sealers according to aspects of this invention can be adapted to seal tubes such as those illustrated in FIGS. 1*a*, 1*b* and 2. Referring to those figures, a tube portion 2 is illustrated with two (2) seals 4, thereby separating an interior 6 of the tube portion 2 into multiple sections or compartments. As is illustrated in FIGS. 1*a* and 1*b*, the tube portion 2 may have a diameter D and a wall thickness T1. The dimensions of the tube portion 2 can be varied depending upon the nature of the tube and the use thereof.

The tube portion 2 may be a tube used to collect a sample of blood from a donor. If so, the tube portion 2 may be formed from polyvinyl chloride (PVC) or any another suitable material. The seals 4 in the tube portion 2 are formed by compressing the tube so that its walls come into contact with one another and simultaneously subjecting the tube portion 2, in the area of a seal 4, to energy until a seal is formed by heating and softening or melting the tube such that a weld can be formed.

Referring to FIGS. 1*a*, 1*b* and 2, the seals 4 formed in tube portion 2 will have a width W, a height H, and a thickness T2. It has been discovered that it may be desirable to modify, select, and/or control the "size" or "area" defined by one or more of the dimensions W, H, and T2. Generally, there is likely to be some limited flow of the material of the tube in the area of a seal during the formation of the seal. More specifically, the softening or melting of the material of the tube is likely to cause some migration of the material radially outwardly to arrive at a height H of the seal 4 that is greater than diameter D of the tube. Also, the width W of the seal 4 will result from some migration of the material of the tube along the axis of the tube.

The dimensions W, H, and T2 of each seal 4 are impacted by various parameters relating to the energy used to form the seal as well as the jaws of the sealer that directly form the seal. These parameters include the degree of compression imparted on the tube by the jaws (i.e., the minimum gap between the jaws), the duration of the compression (i.e., the time delay before the jaws are separated), and the duration over which the radio frequency energy is generated, among other parameters. It has been discovered that it may be beneficial to permit the adjustment of a tube sealer with respect to one or more of these parameters, as will be discussed later in greater detail.

Referring again to FIGS. 1*a* and 1*b*, a "good" or "successful" weld or seal 4 across a tubing portion 2 will be likely to exist if the combination of melting of the tubing with the compressive force exerted by the jaws forming the seal force lateral flow of the plastic to develop ears or tab portions disposed on opposite sides of the tubing. Such ears or tabs may be indicative of an impermeable seal across the tubing.

Generally referring to FIGS. 3-7, one aspect of this invention provides a dielectric tube sealer 8 adapted to limit radio frequency emissions or emanations during operation. The dielectric tube sealer 8 includes an enclosure such as a cabinet 10 and first and second jaws 42 and 26, respectively, oriented with respect to the cabinet 10 to receive a tube portion in a space therebetween. The first jaw 42 is fixed and is coupled to a radio frequency generator, and the second jaw 26 is movable with respect to the first jaw 42 and is coupled to ground potential. A shield 12 is positioned adjacent the cabinet 10 and configured to at least partially enclose the first and second jaws 42 and 26 yet permit the introduction of a tube portion to a position between the first and second jaws 42 and 26. The shield 12 thereby reduces radio frequency emanations from the first jaw 42, and the shield 12 can be movable with respect to the cabinet 10 to at least partially expose the first and second jaws 42 and 26.

According to another aspect of the invention, a dielectric tube sealer 8 is adapted to detect successful or failed seals. The dielectric tube sealer 8 includes jaws 26 and 42 mounted for movement with respect to one another between (1) a first position spaced from one another to receive a tube portion and (2) a second position proximal one another to compress the tube portion, wherein the jaws 26 and 42 in the second position define a gap selected to form a successful seal. The dielectric tube sealer 8 also includes a sensor 204 positioned to detect when the jaws 26 and 42 have moved into the second position. The dielectric tube sealer 8 also includes a timer electrically coupled to the sensor 204 for determining the time delay before the jaws 26 and 42 have moved into the second position. A time delay up to a predetermined time limit indicates a successful seal, and a time delay exceeding the predetermined limit indicates a failed seal.

According to another aspect of the invention, a dielectric tube sealer 8 includes a radio frequency generator configured to generate radio frequency for a time period. Jaws 26 and 42 are mounted for movement with respect to one another, one of the jaws 26 or 42 being coupled to the radio frequency generator. The dielectric tube sealer 8 also includes a microprocessor or microcontroller 206 configured to control the radio frequency generator. The microcontroller 206 is programmable to select the time period during which radio frequency is generated by the radio frequency generator, thereby controlling the area of the seal formed in a tube.

Referring to FIGS. 3-7, exemplary features of one embodiment of a tube sealer according to this invention will now be described. The dielectric tube sealer 8 includes a cabinet 10 to which a cover or shield 12 is removably mounted. The dielectric tube sealer 8 also includes a power switch 14 which acts as an on/off switch for the operation of the unit. The dielectric tube sealer 8 further includes a power indicator 16 and a seal indicator 18, both of which may take the form of an LED according to one exemplary embodiment of the invention. The seal indicator 18 will be on when the solenoid is energized. When the shield 12 is off and the unit is inoperable, the seal indicator 18 will flash (except when the unit is in programming mode as will be described later).

Figure 4:
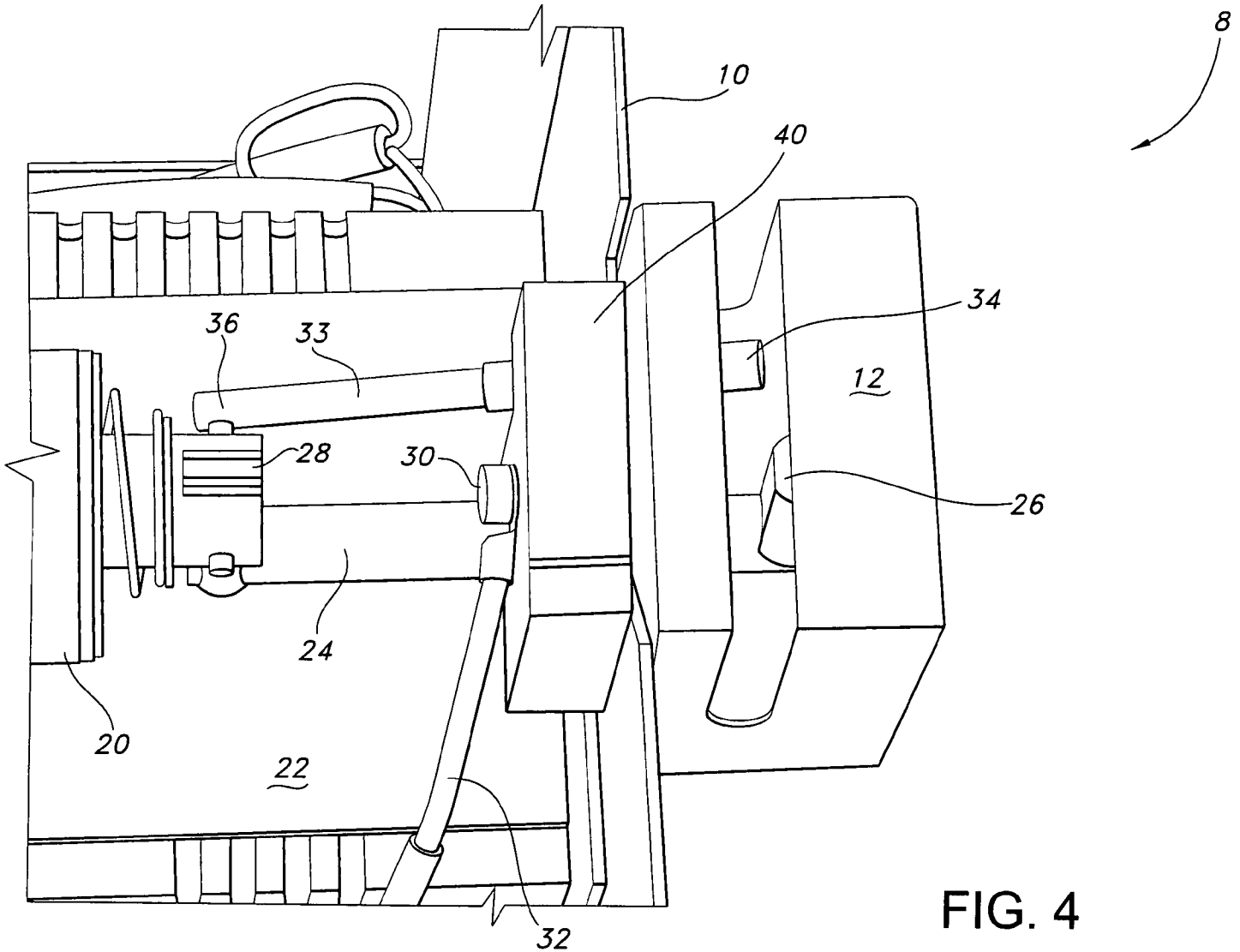
FIG. 4 is a top perspective view of the tube sealer shown in FIG. 3.

Referring specifically to FIG. 4, which reveals internal features of the dielectric tube sealer 8, a solenoid 20 is mounted on a mounting platform 22 within an interior of the cabinet 10. It will be noted that, although cabinet 10 is adapted as a table-top unit, cabinet 10 may also be reconfigured as a hand-held device that is remote from other components that are illustrated within the cabinet 10 in FIGS. 3-7. Coupled to the solenoid 20 is a ground jaw shaft 24 on which the ground jaw 26 is positioned. A flag 28 is provided as a part of the assembly of the ground jaw shaft 24 in order to actuate a stop sensor 204, which will be described in further detail later.

Figure 5:
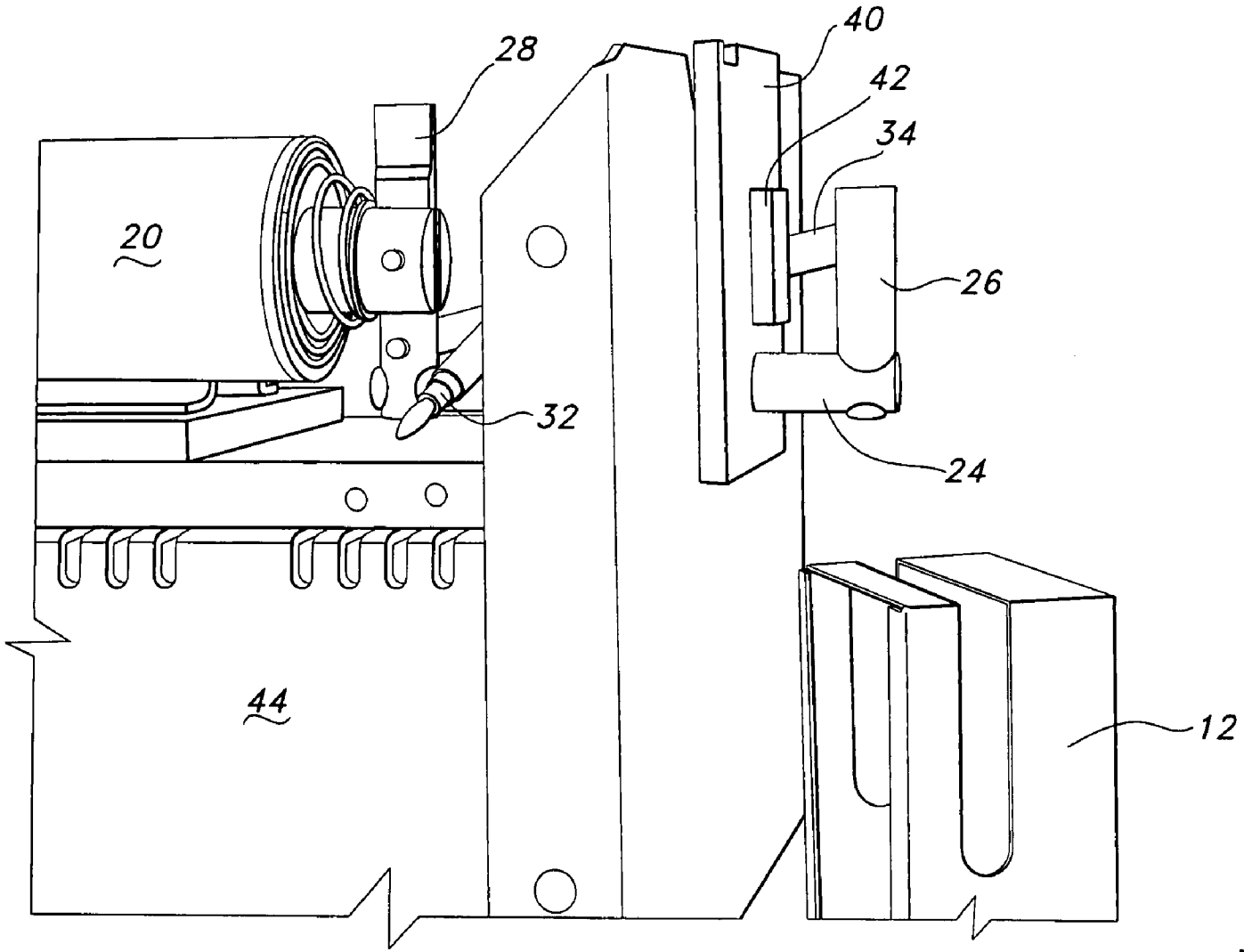
FIG. 5 is a side perspective view of the tube sealer shown in FIG. 3.

A fastener 30, which may take the form of a cap-head screw or any other suitable fastener, is used to make a connection between a wire 32 leading to a radio frequency board (FIG. 10) and the RF jaw 42 (see RF jaw 42 in FIG. 5, for example). A start lever 33 is also provided as a component of the dielectric tube sealer 8. The start lever 33 has a proximal end 34 and a distal end 36, wherein the proximal end 34 extends outwardly from the cabinet 10 and the distal end 36 extends inwardly into the interior of cabinet 10. The proximal end 34 of the start lever 33 is depressed downwardly when a tube is introduced into a position between the ground jaw 26 and the RF jaw 42, and the distal end 36 of the start lever 33 is pivoted upwardly. A flag (not shown) toward the distal end 36 of start lever 33 actuates a start sensor 205 (FIG. 11), details of which will be provided later.

The start lever 33, ground jaw shaft 24, and connection to the RF jaw 42 each passes through an insulator 40. According to exemplary aspects of the invention, the insulator 40 is in the form of a block of insulating material. The insulating material may be DELRIN, for example, or any other suitable insulator. If DELRIN is used, it is preferably black to provide a UV protectant. The insulator 40 serves two (2) purposes according to exemplary features of this invention; namely, it isolates the radio frequency potential applied to the RF jaw from the ground potential of the ground jaw and it provides a low-friction surface through which moving parts (e.g., ground jaw shaft 24) can slide.

Referring to FIG. 5, it will be seen that a portion of the RF jaw 42 extends outwardly beyond the surface of the insulator 40, thereby exposing a surface of the RF jaw 42 for contact with a tube portion to be sealed. Also shown in FIG. 5 is a power supply 44, which is positioned under the mounting platform 22. Although not shown in FIG. 5, it has been discovered that there is benefit in selecting a power supply 44 that incorporates a fan for heat dissipation. Heat will of course be generated within the cabinet 10 by virtue of the operation of the solenoid 20 and other components of the system. It has been discovered that the positioning of a power supply 44 toward the base of the cabinet 10 can help dissipate significant heat when the power supply 44 is provided with the fan. More specifically, the fan of the power supply 44 exhausts heat downwardly and outwardly through a base portion of the cabinet 10.

Referring still to FIG. 5, the RF jaw remains fixed with respect to the cabinet 10 and the ground jaw 26 moves with respect to the RF jaw 42 by virtue of sliding movement of ground jaw shaft 24 through an aperture in the insulator 40 and the action of the solenoid 20. More specifically, upon actuation of the dielectric tube sealer 8 to seal a portion of a tube, the solenoid 20 will withdraw the ground jaw shaft 24 toward the interior of the cabinet 10, thereby moving the ground jaw 26 closer the RF jaw 42. In that manner, the jaws 26 and 42 have two (2) positions; namely, an open position in which the jaws 26 and 42 are separated from one another a distance sufficient to receive a tube, and a closed position in which the jaws 26 and 42 are proximal to one another such that a tube positioned therebetween will be in a compressed state. The gap between the jaws 26 and 42 when the jaws are in the closed position is selected to correspond substantially to the desired thickness T2 of the seal 4 (see FIG. 2).

That gap can be periodically adjusted during calibration of the dielectric tube sealer 8 to ensure that an appropriate thickness T2 is imparted to a seal. Also, the gap can be adjusted to avoid arcing between the jaws, which would otherwise occur if the jaws were too close together. On the other hand, if the jaws are too far apart, the seal of the tube might not be properly formed and might leak.

When the jaws 26 and 42 are in the closed position (not shown), the flag 28 on the opposite end of the ground jaw shaft 24 will block an optical sensor such as stop sensor 204 to signal that the seal is virtually complete. Accordingly, the flag 28 is sized and positioned to actuate such a sensor as the jaws 26 and 42 enter the closed position. For example, when the gap between jaws 26 and 42 is reduced to a predetermined size (e.g., 0.1 mm-0.2 mm), the flag 28 will trigger the sensor to indicate full compression of the tubing.

Figure 12:
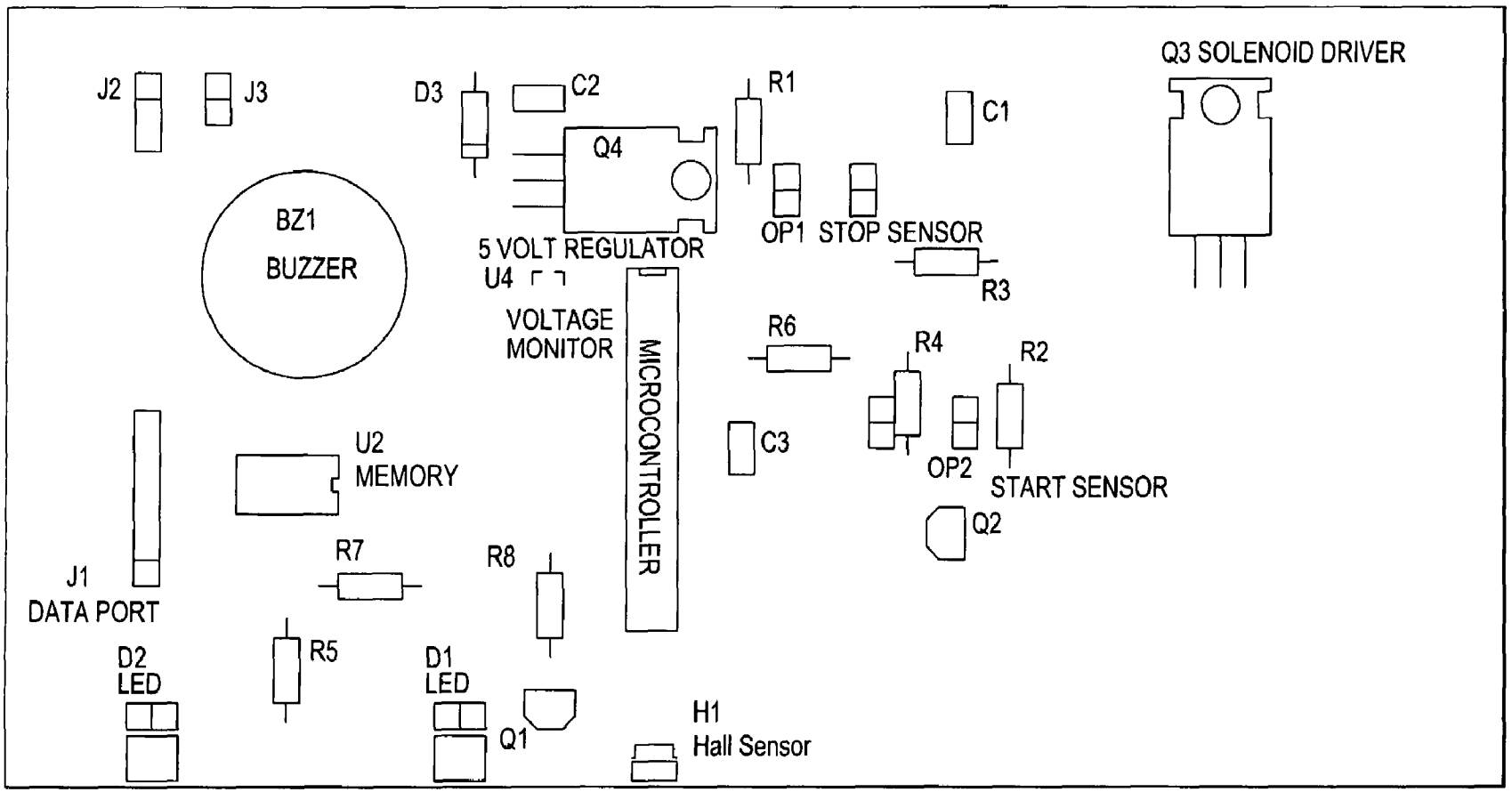
FIG. 12 illustrates an embodiment of a control board according to aspects of this invention.

Although not shown in FIGS. 3-7, a controller board, such as the exemplary embodiment of a board shown in FIG. 12, is mounted in a horizontal position extending rearwardly from the top of the insulator block 40. Standard fasteners can be used to fasten the board to the insulator block 40 or to otherwise mount the board within the cabinet 10. The sensors for sensing the flags on the start lever 33 and the ground jaw shaft 24 are mounted to the controller board and are positioned on the board in locations selected to correspond to the respective flags on the start lever 33 and ground jaw shaft 24.

Figure 6:
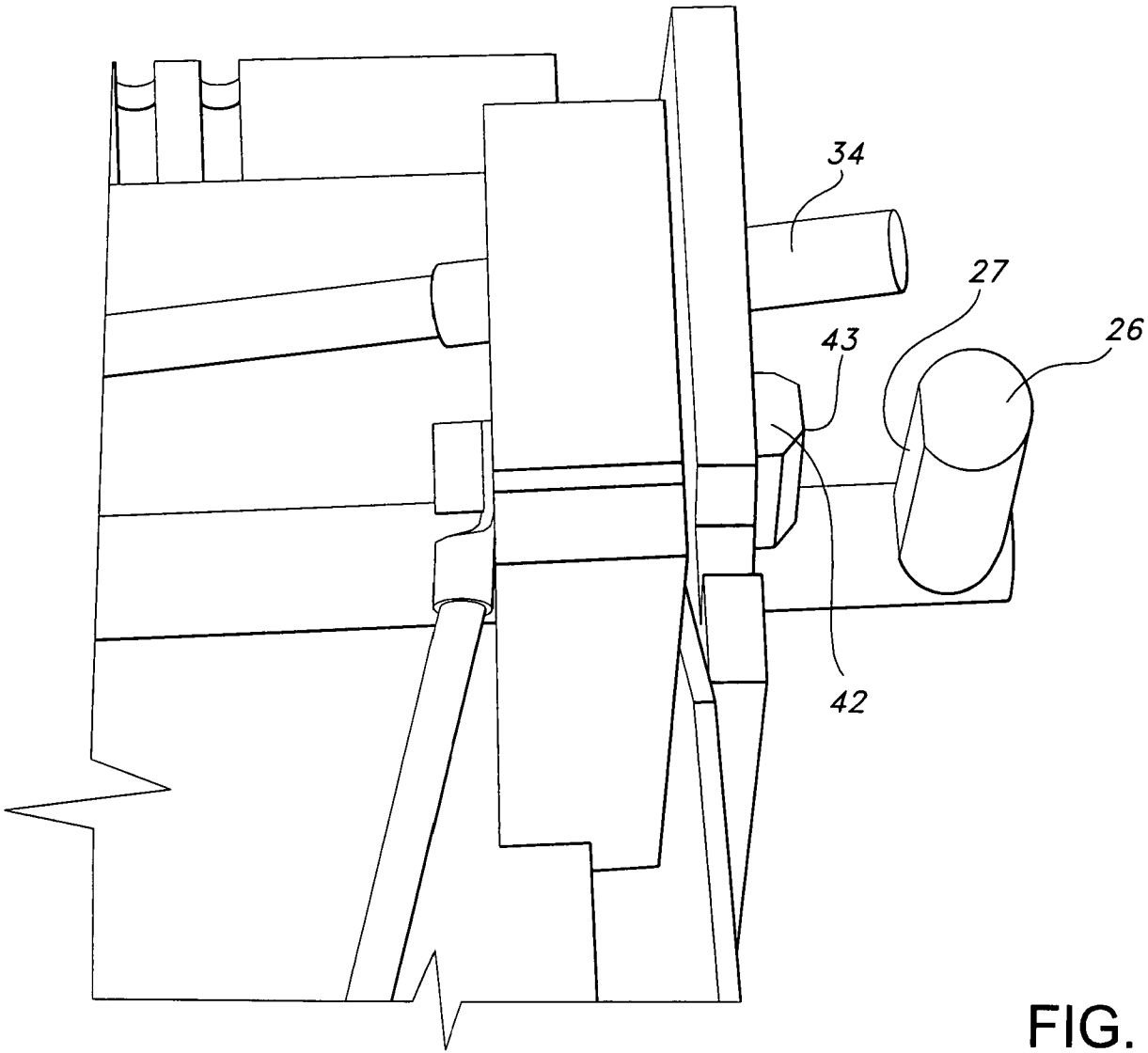
FIG. 6 is another top perspective view of the tube sealer shown in FIG. 3.

Referring now to FIG. 6, it will be seen that the RF jaw 42 is provided with a substantially flat surface 43 for contact with a tube portion to be sealed. Similarly, the ground jaw 26 is also provided with a substantially flat surface 27 for contact with the opposite side of the tube portion. These flat surfaces 27 and 43 are sized and oriented so as to impart a predetermined configuration to a seal 4 in a tube portion 2. It will be appreciated that the widths and other dimensions of the flat surfaces 27 and 43 can be modified so as to alter the configuration of the seal 4. More specifically, the surfaces 27 and 43 can be modified to impart functional or ornamental features to the surface of the seal, depending upon the particular application or preferences of the end user. Also, the texture or finish of the surfaces 43 and 27 can be modified to impart a particular surface feature to the seal.

As shown in the figures, the ground jaw shaft 24 is substantially rounded in cross-sectional shape. For example, a cylindrical shape for ground jaw shaft 24 can be selected to correspond to a through-hole formed in the insulator 40. Also, a cylindrical shaft or otherwise rounded shaft may be easier to clean in the instance of leaked fluids because the cylindrical shape will not encourage an accumulation of fluids on the ground jaw shaft 24. The portion of ground jaw shaft 24 on which the ground jaw 26 is formed is also substantially cylindrical except for the flat surface 27 formed thereon.

As is best illustrated in FIG. 5, it will be seen that the axis of the longitudinally extending portion of the ground jaw shaft 24 is spaced from, but substantially parallel to, the axis of the solenoid 20. Also, the axis of the solenoid 20 corresponds to the position on the RF jaw 42 and ground jaw 26 that contact a tube portion to be sealed. In order to provide this feature, the ground jaw shaft 24 (extending all the way from the flag 28 extending upwardly beyond the axis of the solenoid to the top of the ground jaw 26) forms a substantially "U" shaped configuration. Such a configuration makes it possible to compress a tube portion along an axis of compression that is common to the axis of the solenoid 20.

The ground and RF jaws are, according to one exemplary embodiment, formed from a metal but can optionally be formed from any conductive material. The jaws can be formed from steel plate or rod by known forming techniques.

It has been discovered that the configuration of the RF jaw as a fixed jaw at least partially insulated and located adjacent the cabinet 10 helps to reduce the radio frequency emanations from the dielectric tube sealer 8. More specifically, the mounting of the RF jaw at least partially within an insulator block such as insulator 40 helps to shield the emanations of radio frequency energy. This can be accomplished by configuring the ground jaw 26 to be the moving jaw that extends outwardly from the cabinet 10. By exposing the ground jaw 26 as the outer jaw, as opposed to the RF jaw 42, the radio frequency emanations from the dielectric tube sealer 8 are further reduced. The configuration of the ground jaw shaft 42 as an exemplary "U" shaped configuration permits the orientation of the stationery RF jaw 42 in or near the cabinet with the ground jaw 26 extending outwardly beyond the RF jaw 42.

Figure 7:
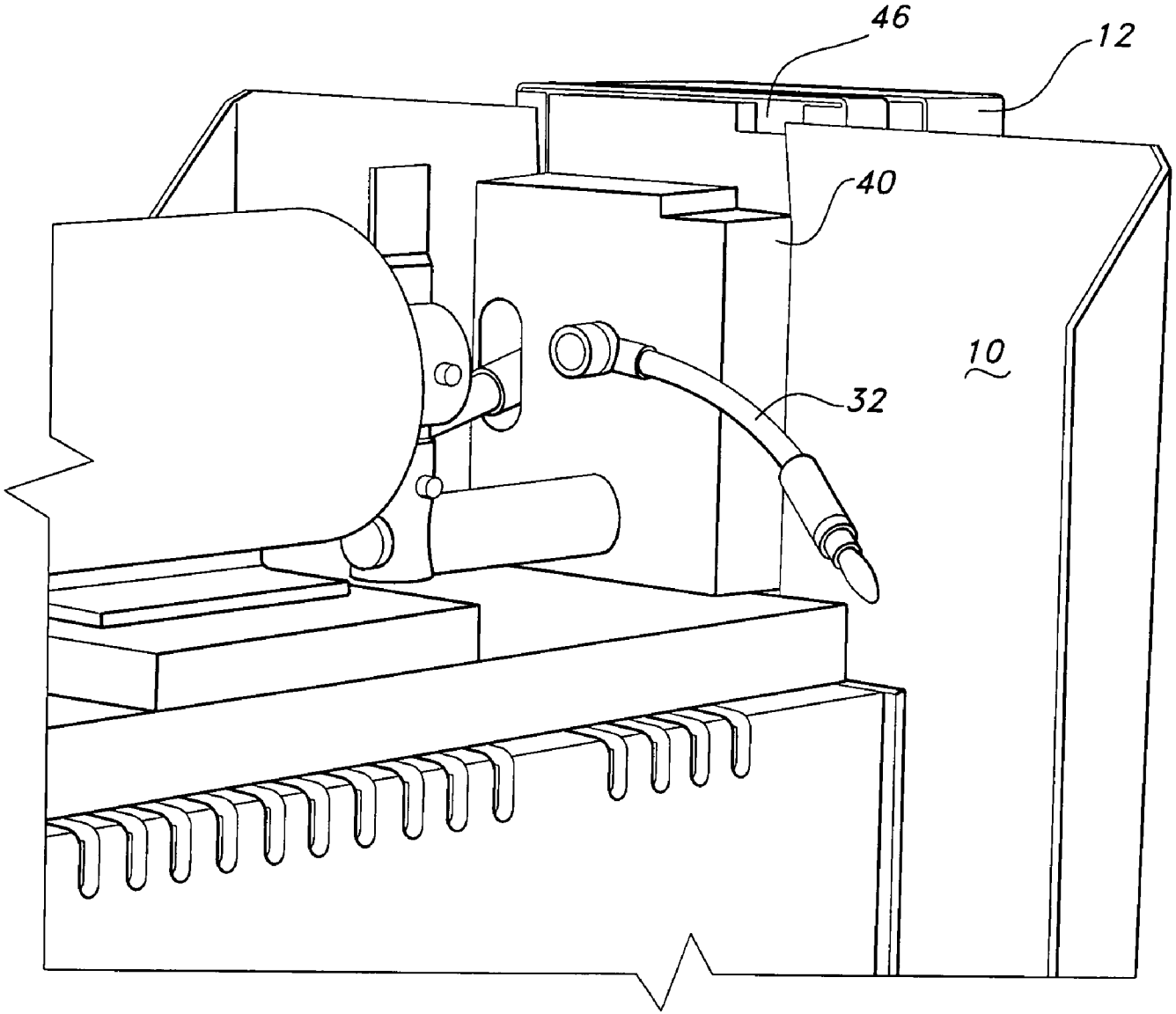
FIG. 7 is a rear perspective view of an interior region of the tube sealer shown in FIG. 3.

Referring now to FIG. 7, a magnet 46 is mounted to a portion of the shield 12. Although not shown in FIG. 7, HALL effect sensor "H1" on the control board shown on FIG. 12 corresponds in position to the magnet 46 when the shield 12 is in place and the control board is mounted within the cabinet 10. By virtue of the HALL effect sensor, therefore, the presence or absence of the magnet 46 (and therefore the presence or absence of the cover or shield 12) can be detected.

It has been discovered that combined features of the exemplary dielectric tube sealer 8 cooperate to reduce emanations of radio frequency energy during operation of the sealer. Although each of the foregoing features helps to reduce radio frequency emanations, the combination of the shield 12, the at least partial insulation of the stationery RF jaw 42, and the outward positioning of the movable ground jaw 26 provide significant reductions in RF emanations.

Also, the configuration of the jaws and the insulator with respect to one another helps to prevent arcing between the jaws (e.g., arcing between ground and RF potentials). More specifically, the extension of jaw 42 outwardly from the insulator 40 helps to prevent bridging of fluids such as blood between the RF jaw 42 and the ground jaw shaft 24.

In the exemplary embodiment illustrated in the figures, the shield 12 is removably mounted adjacent the cabinet 10. Removal of the shield 12 facilitates cleaning and maintenance of the jaws and other components of the tube sealer 8. As will be described later in greater detail, the removal of the shield 12 also facilitates the periodic calibration of the tube sealer to maintain an appropriate seal thickness and facilitates the programming of the tube sealer.

While the exemplary shield 12 is removable and replaceable by virtue of a sliding engagement with the insulating block 40, the tube sealer is configured to prevent its operation while the shield 12 is not in place. Contact between the shield 12 and the cabinet (e.g., by virtue of the flanges of the shield 12 extending between the insulator 40 and the cabinet 10) is optionally provided to is ground the shield 12.

The shield 12 may be formed from a conductive material such as a metal. The slot (not numbered) in the shield 12 permits a user to insert a portion of the tube to be sealed between the jaws of the dielectric tube sealer 8. The shape and configuration of the slot and the body of the shield are not important, however.

Figure 8A:
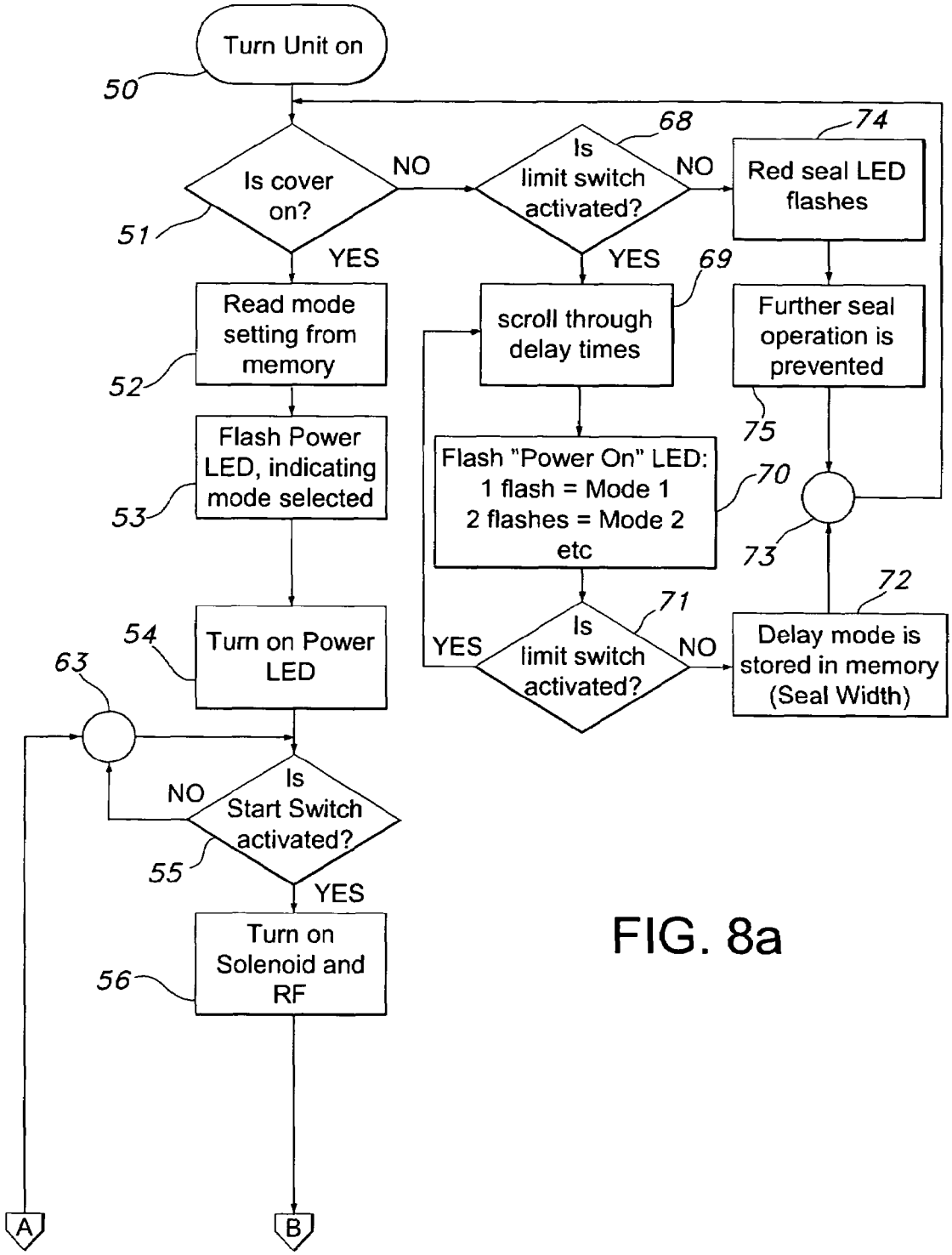
FIGS. 8*a* and 8*b* provide a flow diagram illustrating the use of an embodiment of a tube sealer according to aspects of this invention.
Figure 8B:
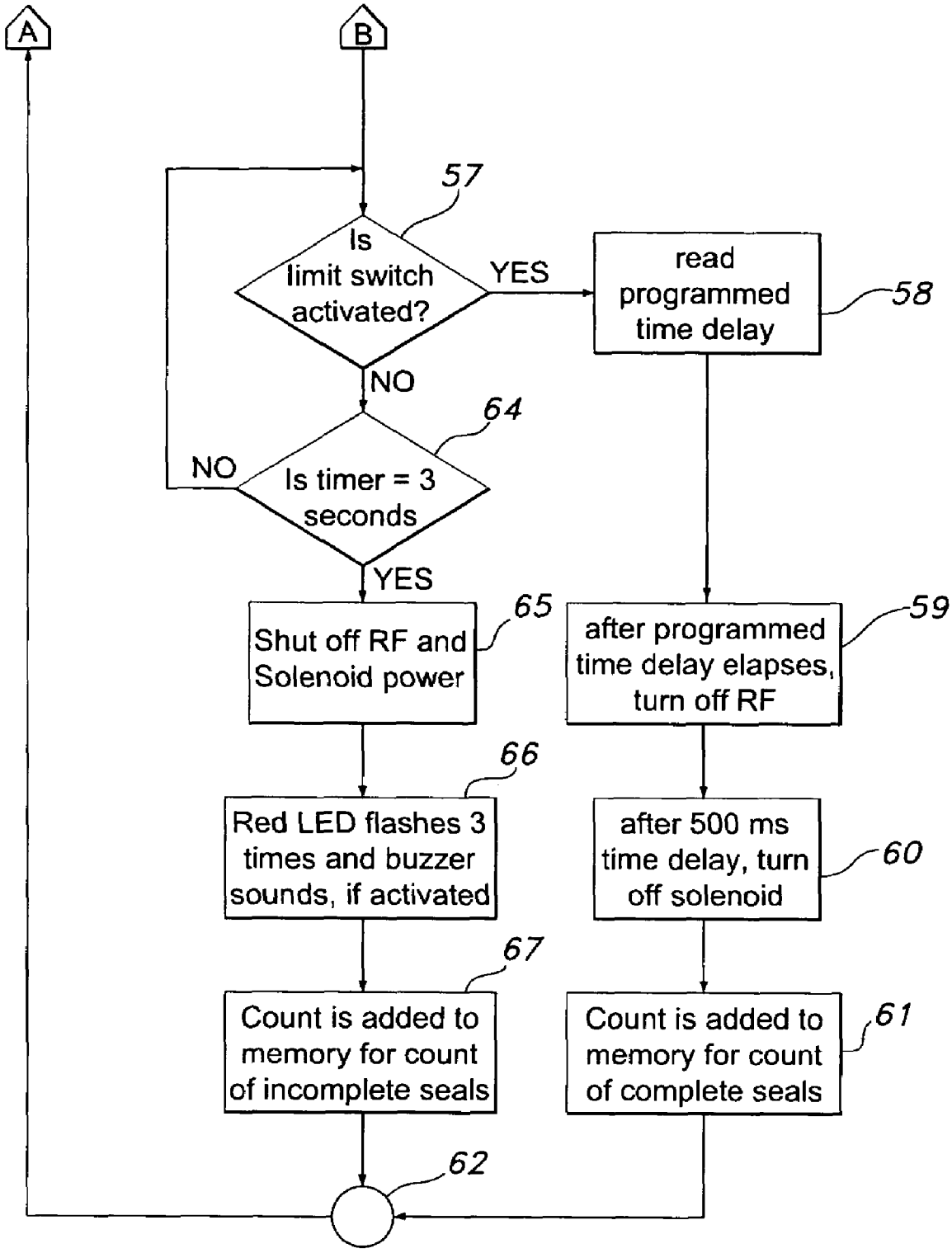

Referring now to FIGS. 8*a* and 8*b*, a flow diagram illustrating operation of an exemplary embodiment of a tube sealer according to this invention will now be described. Steps 50-63 roughly correspond to an exemplary sealing operation of the unit, steps 64-67 illustrate exemplary operation of the system in connection with a failed seal, steps 68-73 illustrate an exemplary programming mode, and steps 74 and 75 illustrate an exemplary inoperable mode.

Referring first to the exemplary sealing operation illustrated in steps 50-63 in FIGS. 8*a* and 8*b*, the unit is turned on in step 50, which is followed by a query in step 51 as to whether the cover or shield 12 is in place. This query can be answered, for example, by use of a Hall sensor to detect the presence or absence of a magnet 46 on the shield 12. In step 52, the mode setting is read from the memory of the sealing unit, and the power LED is flashed in step 53 to indicate the mode selected. The number of flashed of the LED can indicate the mode. The mode may correspond, for example, to the time delay mode selected in steps 68-73 (described later). After the mode selected is indicated, the power LED is turned on in step 54.

In step 55, a query asks whether the start switch has been activated. This query can be answered, for example, with the use of an optical sensor such as the start sensor 205 to detect the presence or absence of a flag on a distal end 36 of the start lever 33, which would indicate that a tube portion has been inserted between the jaws of the sealer, thereby depressing the proximal end 34 of the start lever 33. If the start switch has been activated, the solenoid and RF generator (and red seal LED) are turned on in step 56. Step 57 queries whether the limit switch is activated, which can be answered, for example, depending on whether the flag 28 on the ground jaw shaft 24 is sensed by the optical sensor or stop sensor 204 on the control board. If so, the programmed time delay is read in step 58 and the RF generator is turned off after the programmed time delay elapses in step 59. After a predetermined time (e.g., 500 ms), which may be selected based on the amount of time desired for the seal to cool adequately, the solenoid (and red seal LED) is turned off in step 60, and a count is added to the memory for an updated count of complete seals in step 61. The successful seal is then completed in step 62 and the unit can then be readied to create another seal at step 63. If at any time during power "on" of the sealer the sealer cover 12 is removed, then the seal LED remains flashing and the unit will not respond to the start sensor 205.

Referring now to the exemplary failed seal mode in steps 64-67, a query is made in step 64 to determine whether 3 seconds, or some other predetermined delay, has elapsed since the solenoid and RF generator were turned on in step 56. If so, that means that too much time has elapsed since the start of the sealing process without a full seal being indicated by the limit switch. In other words, thereby indicating that the seal has not yet been made. If so, the RF generator and solenoid power are shut off in step 65, and the seal LED flashes 3 times to indicate to the user of the sealer that the seal was unsuccessful in step 66. If a buzzer is incorporated into the sealer system as an audible indicator to the user and the buzzer is programmed to activate, then the buzzer is sounded in step 66. In step 67, a count is added to the memory to updated the count of incomplete seals and the sealer is readied for another attempt at steps 62 and 63.

Referring now to the exemplary programming mode in steps 68-73, if the cover is off (step 51) and the limit switch or stop sensor 204 is activated (step 68) during system start up, then the sealer unit scrolls through a menu of available delay times in step 69. Accordingly, the programming mode in steps 68-73 is initiated by removing the cover 12, pushing the ground jaw 26 in to activate the limit switch, turning the unit on, and selecting a delay time. In step 70, the power LED can flash as an indicator of a variety of selectable delay times and/or an audible alarm mode. In one embodiment, six (6) modes are available for selection.

Program mode is initiated when the shield 12 is off, the limit switch is activated, and the power is then turned on. If the cover or shield is removed after power up and the limit switch is triggered, the unit will not enter program mode.

For example, one flash may correspond to a particular mode with a delay time. As mentioned, the user of the system can activate the limit switch (step 68) by pushing in the ground jaw shaft 24 or ground jaw 26 while the cover is off. While in the programming mode, the system will continue to scroll through the menu of possible delay times until the limit is switch is deactivated at step 71. In other words, if the limit switch remains activated (e.g., by the user retaining the ground jaw shaft 24 in a closed position) then the system will continue to scroll delay times. Upon release of the ground jaw shaft 24 by the user, the limit switch will thereby be deactivated in step 71 and the delay mode selected by the user by deactivating the limit switch is then stored in the memory in step 72.

The various programmed modes may determine the delay times and/or the nature of the indicator with respect to failed and successful seals. For example, a menu of program modes can include modes configured to sound an audible alarm (e.g., a buzzer) in the event of a failed seal. Alternatively, modes can dictate a silent, visual alarm depending on the preferences of the end user.

In one exemplary embodiment, six (6) modes are provided to offer three delay times with an audible indicator and three delay times without the audible indicator. The delay times can be, for example, 50 ms, 100 ms, and 150 ms, but a variety of delay times can be provided depending on the material to be sealed, the size of the tubing, the application for the tube sealer, and other factors.

As indicated in step 72, the delay mode selected by the user will correlate to a desired seal width. Generally, the longer the delay time (i.e., prior to turning off the RF generator), then the wider the seal may be. After step 72, the programming mode is concluded at step 73.

Referring now to an exemplary inoperable mode of the dielectric tube sealer 8 in steps 74 and 75, if the cover is off (step 51) and the limit switch is not activated (step 68), then the unit should not be operated by a user and a warning is delivered to the user in the form of the flashing of the seal LED in step 74. As indicated in step 75, further seal operation is prevented, and the system is returned to the query of whether or not the cover is on (step 51).

Figure 9:
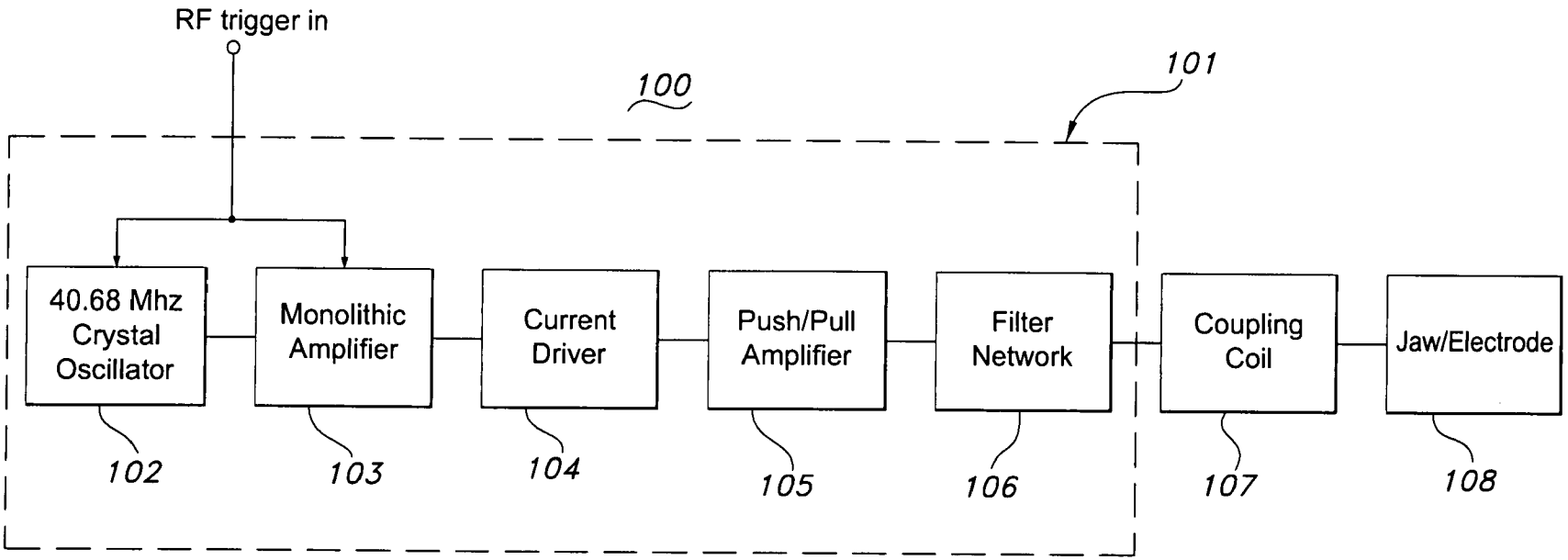
FIG. 9 provides block diagram of a radio frequency amplifier according to aspects of this invention.

Referring next to FIG. 9, there is shown an exemplary block diagram of a radio frequency (RF) energy generator, generally designated as 100, for providing RF power to melt and weld a seal across a plastic tube. As shown, RF energy generator 100 includes RF amplifier 101, coupling coil 107 and jaw/electrode 108. RF amplifier 101 may include crystal oscillator 102, monolithic amplifier 103, current driver 104, push/pull amplifier 105, and filter network 106. These are discussed below.

Figure 10:
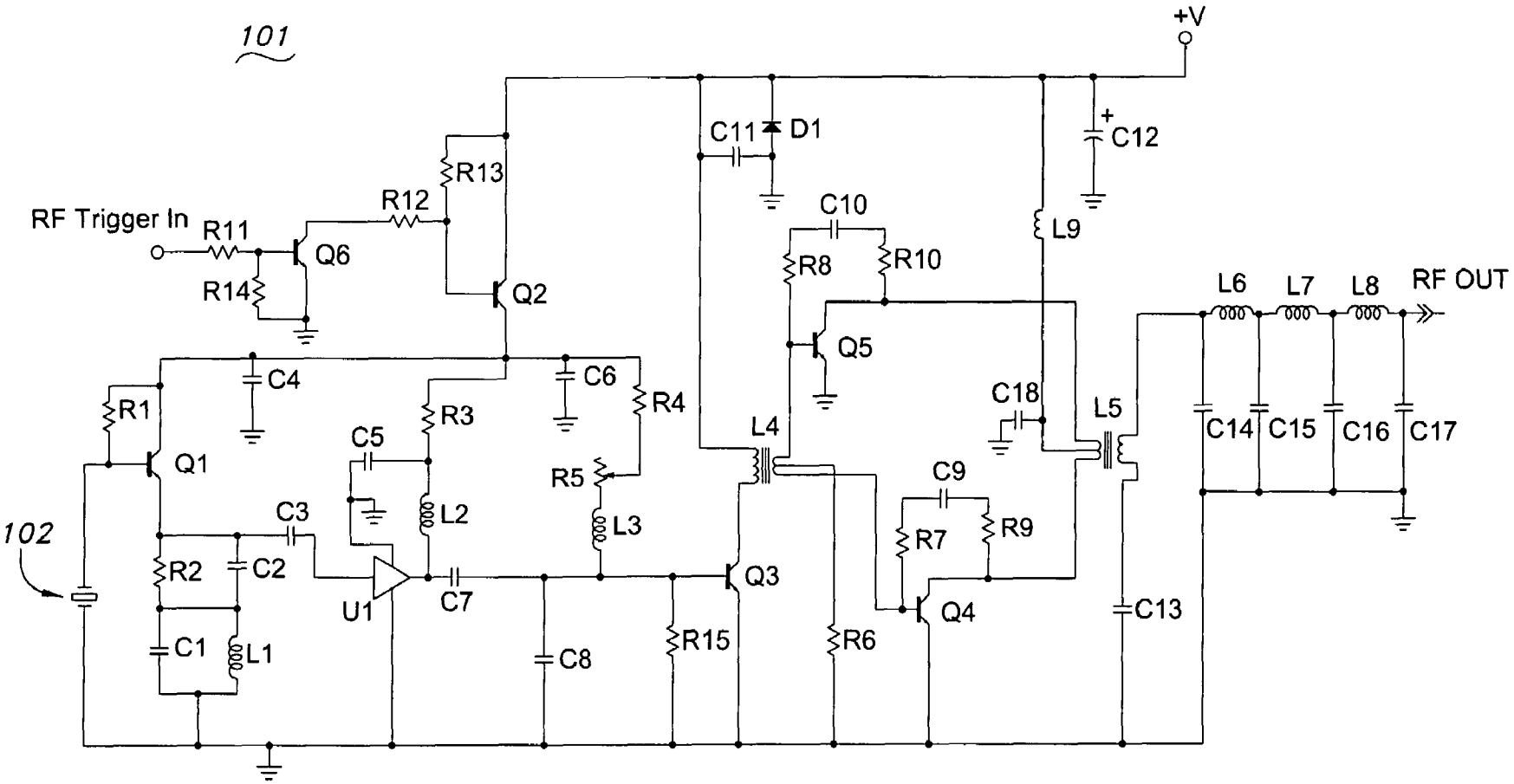
FIG. 10 illustrates a circuit diagram for an embodiment of an exemplary radio frequency generator according to aspects of this invention.

An exemplary electrical circuit of RF amplifier 101 is shown in FIG. 10, and may include electrical components that are surface mountable on a single board. Referring to both FIGS. 9 and 10, there is shown crystal oscillator 102 capable of providing an RF signal at 40.68 MHz. The RF signal provided by crystal oscillator 102 may be filtered by a network of components (R2, C1, C2, C3 and L1) prior to amplification by monolithic amplifier 103. The monolithic amplifier, designated as U1 in FIG. 10, may be a MAV11 monolithic amplifier for providing an amplified RF output that may be adjustable by way of resistive components R4, R5 and R15. The RF energy is adjustable largely by potentiometer R5. Alternatively, resistive components R4 and R5 can be removed, allowing the amplifier to run at maximum power, which will be controlled by fixed resistor R3.

The crystal oscillator and monolithic amplifier may be turned on/off by way of switching transistors Q6 and Q2. Upon activation by RF trigger input signal (provided from a control circuit, discussed below), transistors Q6 and Q2 may be turned on, thereby allowing voltage, +V, to saturate transistor Q1 and start RF oscillation. Switching transistors Q6 and Q2 will activate monolithic amplifier U1 to amplify the RF oscillation.

The output energy from monolithic amplifier 103 may be filtered by various components including C5, C7, C8, L2 and L3. The filtering advantageously prevents RF energy from feeding into the power supply and noise from reaching a microcontroller residing on the control circuit (discussed below). The output energy from monolithic amplifier 103 is further amplified by current driver 104 and push/pull amplifier 105. Current driver 104 may include power amplifier Q3 for driving step-down transformer L4 (5T to 1T), which effectively lowers the output voltage and increases the current by a five-to-one ratio. The output of step-down transformer L4 may be provided to push/pull amplifier 105. In the exemplary embodiment of FIG. 10, the push/pull amplifier may have a configuration that includes transistors Q4 and Q5 for driving step-up transformer L5 (1T to 3T).

The amplified RF output signal from push/pull amplifier 105 may be low pass filtered by filter network 106 and may include components L6, L7, L8, C13, C14, C15, C16 and C17. It will be appreciated that filter network 106 may provide a cut-off frequency for RF harmonics above the baseband frequency of crystal oscillator 102.

Completing description of RF amplifier 101, additional filtering components may be included on the surface mountable RF board, such as D1, L9, C11, C12 and C18. These additional filtering components may further prevent RF noise from reaching the power supply (+V, for example) and the microcontroller on the control circuit.

In the embodiment shown, the amplified RF output signal is sent to coupling coil 107, which may be mounted separately from RF amplifier 101. Coupling coil 107 may be included to provide a matching impedance (50 ohms) between filter network 106 and jaw electrode 108. In this manner, sufficient RF energy may be radiated from jaw electrode 108 to provide efficient melting and welding of the plastic tubing.

In the RF circuit of FIG. 10, monolithic amplifier U1, may be configured to provide approximately 8-9 dB of amplification. Coupled between oscillator 102 and current amplifier Q3, the monolithic amplifier amplifies the low output signal from oscillator 102 and may achieve a maximum output power of 0.5 watts, for example. Sufficient gain is provided from the monolithic amplifier to directly drive current amplifier Q3.

It will be appreciated that the monolithic amplifier is optionally utilized to provide gain in a single stage that conventionally may require three or more stages of amplification. The monolithic amplifier also requires less filtering. As a result, the RF circuit may be compact and small in size. The monolithic amplifier may, for example, be an MAV-11 amplifier manufactured by Mini-Circuits in Brooklyn, N.Y.

Figure 11:
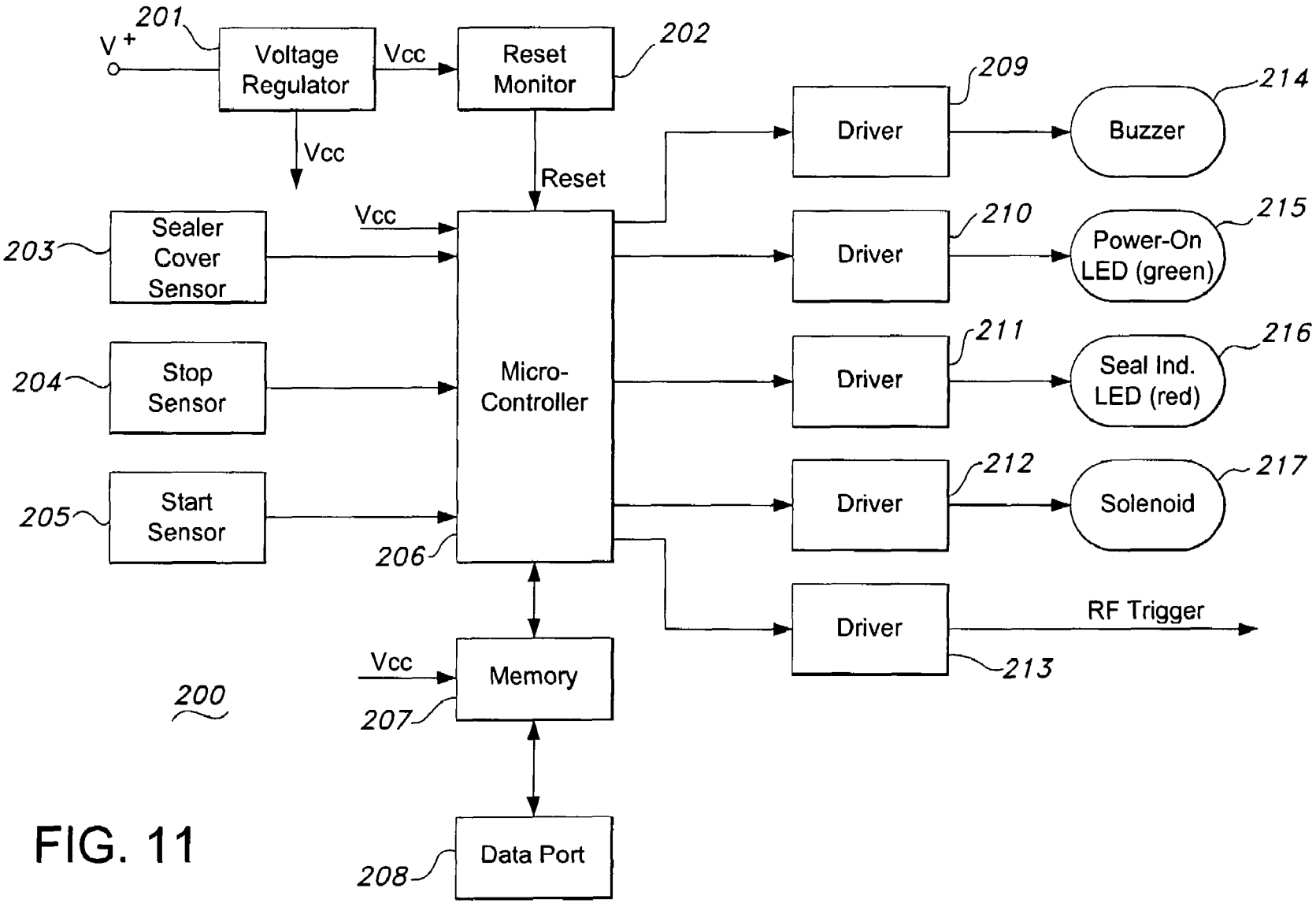
FIG. 11 illustrates a block diagram of an embodiment of a control circuit according to aspects of this invention.

Referring to FIG. 11, an exemplary embodiment of a control circuit, generally designated as 200, will now be described. Control circuit 200 is adapted for monitoring and controlling the tube sealing operation. The control circuit may also provide status and alerts to the operator (or user). As shown, the heart of the control circuit is microcontroller 206, and, for example, may be AVR microcontroller ATtiny 28L. In the embodiment shown, microcontroller 206 monitors sealer cover sensor 203, stop sensor 204 and start sensor 205. In response to these sensors and in response to a programmed method of operation, microcontroller 206 activates buzzer 214, power on LED (green) 215, seal indicator LED (red) 216, solenoid 217 and RF trigger output to the RF amplifier board. Each of these elements may be activated by way of respective drivers 209-213. Of course, a driver may be omitted, if the microcontroller is capable of directly driving the element.

As shown, microcontroller 206 is coupled to memory 207, which may be an EEPROM, such as FM 25160, and is capable of providing over a billion write operations. One such write operation may include microcontroller 206 storing "good/bad seal" status into memory 207. Another write operation may include storing the modes of operation. Also included may be data port 208 for allowing the user to access memory 207 and obtain status information of a sealing operation.

Control circuit 200 may also include voltage regulator 201 and reset monitor 202. As shown, voltage regulator 201 regulates the $V^+$ voltage (for example 13.8 V) and provides Vcc voltage to both the microcontroller and the memory. Reset monitor 202 may also be included to continuously monitor the Vcc voltage from regulator 201. If the voltage drops below a threshold (for example 4.68 V), microcontroller 206 may be reset by monitor 202.

Describing next the sensor signals provided to the microcontroller, there is shown sealer cover sensor 203, which may be a Hall sensor adapted to sense magnetic fields emanating from a pole magnet 46 disposed on the cover or shield 12. It will be appreciated that the placement of the Hall sensor may be such that if the magnetic fields are absent (or below a threshold), the Hall sensor may effectively alert the microcontroller that the sealer cover is not in a shielding position. In response to the Hall sensor alert, the microcontroller may be programmed to prevent activating the solenoid and the RF trigger signal.

Start sensor 205 may include a combination of a transistor and a photodiode for sensing that the tube is in proper position for sealing. It will be appreciated that the microcontroller may be programmed to prevent activation of the solenoid and the RF energy until the tube is in proper position. In the example shown, start sensor 205 senses an absence of light that results from depression of a lever 33 after the tube has been placed in position. Depression of the lever 33, in turn, raises a flag that blocks the light from reaching the photodiode. Blockage of the light may turn off the transistor and cause activation of a signal to inform the microcontroller that the tube is in position.

In a similar manner, stop sensor 204 may include a similar combination of transistor and photodiode for sensing that a limit switch is to be activated. Activation of the limit switch may indicate that a preset jaw-gap has been reached (or a predetermined thickness of the seal has been reached). Activation of the limit switch may result from movement of a flag such as flag 28 of ground jaw shaft 24 into position to block light from reaching the photodiode of stop sensor 204. Upon turning off the photodiode, the transistor may also be turned off, thereby providing an output signal to inform the microcontroller of the limit switch having been activated.

Turning next to output signals that may be provided by microcontroller 206, there is shown buzzer 214 that may be activated to alert the user that a step in the method is not successfully completed. For example, if sealing is not successfully completed, the buzzer may be activated. In another embodiment of the invention, the buzzer may be omitted.

Power-on LED (green) 215 may be activated by the microcontroller to alert the user that the sealing unit is turned-on. The power-on LED may also be controlled from the microcontroller to flash on-and-off. The microcontroller may be programmed to cause the LED to flash a predetermined number of times to indicate a mode of operation (there may be, for example, six modes of operation corresponding to delay times, as discussed previously).

Seal indicator LED (red) 216 may be activated by the microcontroller to alert the user that the RF energy and the solenoid is activated. The microcontroller may also be programmed to cause the seal indicator LED to flash, for example, if power to the unit is on and the shield cover 12 is not in position. In addition, the seal indicator LED may be programmed to flash a predetermined number of times to indicate, for example, that the RF energy and solenoid power are off.

Completing the description of control circuit 200, microcontroller 206 may be programmed to energize solenoid 217 (item 20 in FIG. 5). The solenoid may be, for example, a 12 V solenoid energized by way of driver 212. The driver may be a transistor-switch that when activated by the microcontroller places a ground potential at one end of the solenoid (the other end already having a 12 V potential).

Microcontroller 206 may be programmed to generate the RF trigger signal for turning on the RF amplifier. Although shown as having driver 213 in the path between the microcontroller and switching transistor Q6 (FIG. 10), it will be appreciated that the AVR microcontroller ATtiny 28L may drive the transistor without need for a driver.

Exemplary physical spacing among the components shown schematically in FIG. 11 are provided in FIG. 12. The controller board may be positioned within the cabinet or other form of enclosure in such a way that the flags of the start lever and ground jaw correspond to the positions of the optical sensors and such that the position of the Hall sensor corresponds to the shield's magnet. A notch is provided in the insulator 40 at a location corresponding to the magnet 46 of the cover 12 to accommodate the Hall sensor.

A connector (such as connector J1 shown in FIG. 12) can be provided for connection between the dielectric tube sealer 8 and an external computer or monitor. For example, a computer can be connected to the dielectric tube sealer 8 by means of the connector to download or upload information. In one exemplary embodiment, a Personal Digital Assistant (PDA) or other computer, communications, or reading device can be connected to download the counts of failed and successful seals. This count information can be used to monitor the amount of the use of the sealer, to schedule maintenance and calibration of the sealer, etc. Also, the recordation of the count helps to track the number of cycles a unit has completed, diagnose problems with the equipment, determine maintenance needs, and make accountings for billing purposes.

Although exemplary embodiments of a tube sealer and method according to this invention have been described, there are others that support the spirit of the invention and are therefore within the contemplated scope of the invention. For example, although the dielectric tube sealer 8 is embodied as a tabletop unit, the jaw components of the system, and optionally the entire system, can be reconfigured as a hand-held unit to improve upon its portability. Also, the configuration of the jaws with respect to the cabinet can be modified. More specifically, although the jaws are shown to be extending outwardly from a cabinet 10 and covered by an external shield 12, the jaws can be positioned entirely within the interior of a cabinet so long as access to the jaws can be provided for the insertion of a tube portion between them.

Although the invention has been described with reference to tube sealers to illustrate exemplary features of the invention, this invention applies with equal benefit to all tube apparatus, whether such apparatus are used to seal, connect, weld, join, cut, or otherwise alter or manipulate tubing. For example, exemplary features of this invention can be applied to sterile tube welders or connection devices such as those used in blood bank or blood center applications.

The foregoing is considered as illustrative only of the many possible variations in the illustrated configurations of the invention, and the foregoing recitation of variations should not be considered to be an exhaustive list. It will be appreciated, therefore, that other modifications can be made to the illustrated embodiment without departing from the scope of the invention. The scope of the invention is separately defined in the appended claims.

What is claimed:

1. A tube apparatus adapted to detect successful or failed tube operations, said tube apparatus comprising:

jaws mounted for movement with respect to one another between (1) a first position spaced from one another and (2) a second position selected to perform a successful tube operation;

a sensor positioned to detect when said jaws have moved into said second position;

a controller electrically coupled to the sensor and configured to stop movement of the jaws when the sensor senses that the jaws have moved into the second position; and a timer electrically coupled to said sensor for determining the time delay before the jaws have moved into said second position, wherein a time delay up to a predetermined time limit indicates a successful tube operation and a time delay exceeding the predetermined limit indicates a failed tube operation.

2. The tube apparatus according to claim 1, said jaws comprising a pair of electrodes.

3. The tube apparatus according to claim 2, wherein at least one of said electrodes is coupled to a source of radio frequency energy.

4. The tube apparatus according to claim 1, further comprising a memory configured to store the quantity of successful or failed tube operations.

5. The tube apparatus according to claim 4, said memory being configured to store the quantity of successful and failed tube operations.

6. The tube apparatus according to claim 1, further comprising an indicator configured to signal a successful or failed tube operation detected by the tube apparatus.

7. The tube apparatus according to claim 6, said indicator being selected from a visual indicator and an audible indicator.

8. The tube apparatus according to claim 1, wherein said tube operation is selected from the group consisting of a seal, a weld, a connection, and a severance.

9. The tube apparatus according to claim 1, further comprising a lever actuable upon receipt of a tube portion between said jaws.

10. The tube apparatus according to claim 9, said lever being associated with a non-mechanical sensor connected to initiate said timer.

11. The tube apparatus according to claim 9, said sensor being a non-mechanical sensor.

12. The tube apparatus according to claim 11, said sensor being an optical or a hall sensor.

13. The tube apparatus according to claim 1, further comprising a non-mechanical sensor to trigger said timer.

14. The tube apparatus according to claim 13, said non-mechanical sensor being an optical or a hall sensor.

15. A tube apparatus comprising:

at least one component moveable to a position indicative of a successful tube operation;

a sensor positioned to detect when said component has moved into said position;

a timer electrically coupled to said sensor for determining the time delay before the component has moved into said position, wherein a time delay up to a predetermined time limit indicates a successful tube operation and a time delay exceeding the predetermined limit indicates a failed tube operation;

a controller electrically coupled to the sensor and configured to stop movement of the jaws when the sensor senses that the jaws have moved into the second position; and a memory coupled to said sensor and configured to store the quantity of successful or failed tube operations.

16. The tube apparatus according to claim 15, wherein said tube operation is selected from the group consisting of a seal, a weld, a connection, and a severance.

17. In connection with a dielectric tube sealer having an energy generator configured to generate energy for a time period and jaws mounted for movement with respect to one another, one of the jaws being coupled to the energy generator, a method for controlling the area of a seal formed in a tube, said method comprising the steps of:

(a) selecting a tube for sealing;

(b) programming a microprocessor with a plurality of time periods during which the energy is generated, each time period corresponding to a size or an area of a seal to be formed in the tube; and (c) selecting a time period from the plurality of time periods during which the energy is generated, thereby controlling the size or the area of a seal formed in the tube.

18. In a tube sealer apparatus configured to perform a tube sealing operation, the improvement comprising:

a sensor coupled to said tube sealer apparatus for detecting the performance of tube sealing operations by said tube sealer apparatus;

a timer electrically coupled to the sensor for determining whether the tube sealing operation is performed within a predetermined time period;

a controller electrically coupled to the sensor and the timer to stop the tube sealing operation if the tube sealing operation is performed within the predetermined time period; and a memory configured for connection to said sensor and for storing the quantity of said tube operations performed by said tube sealer apparatus, wherein said memory is configured for storing the quantity of successful or failed tube operations performed by said tube sealer apparatus.

19. The tube apparatus according to claim 18, further comprising at least one moveable jaw, said sensor being coupled to detect a position of said jaw.

20. The tube apparatus according to claim 18, wherein said memory is a component of said tube apparatus.

21. The tube sealer apparatus according to claim 18, wherein the controller is further configured to stop the tube operation if the tube sealing operation is not performed before the end of the predetermined time period.

22. The tube sealer apparatus according to claim 18, wherein the controller comprises a microprocessor.

23. The tube sealer apparatus according to claim 18, wherein the controller comprises a microcontroller.

24. In a tube apparatus configured to perform a tube operation, the improvement comprising:

a sensor coupled to said tube apparatus for detecting successful or failed tube operations, a controller electrically coupled to the sensor to stop the tube operation when the sensor senses that the tube operation is successfully performed; and a memory configured for coupling to said sensor, wherein said memory is configured for storing the quantity of successful or failed tube operations performed by said tube apparatus.

25. The tube apparatus according to claim 24, further comprising a microprocessor coupled to at least one of said sensor and said memory for determining the success or failure of a tube operation.

26. The tube apparatus according to claim 24, wherein the controller is further configured to stop the tube operation if the tube sealing operation is not performed before the end of the predetermined time period.

27. A tube sealing apparatus for substantially precluding fluid flow communication from one portion of a tube to another portion of the tube, the tube sealing apparatus being adapted to detect successful or failed tube sealing operations, said tube sealing apparatus comprising:

jaws mounted for movement with respect to one another between (1) a first position spaced from one another and (2) a second position selected to form a successful tube sealing operation wherein the tube is compressed to preclude fluid flow communication from one portion of the tube to another portion of the tube;

a sensor positioned to detect when said jaws have moved into said second position; and a controller electrically coupled to the sensor and configured to stop movement of the jaws when the sensor senses that the jaws have moved into the second position.

28. The tube apparatus according to claim 27, wherein said sensor is an optical sensor.

29. The tube apparatus according to claim 27, wherein said sensor is a Hall effect sensor.

30. The tube sealing apparatus according to claim 27, further comprising:

a memory configured to store the quantity of successful or failed tube operations;

said tube sealing apparatus being configured to communicate said quantity from said memory to an external computer or monitor.

31. The tube sealing apparatus according to claim 30, wherein said tube operations are selected from the group consisting of a seal, a weld, a joint and a cut.

32. In connection with a dielectric tube sealer having a radio frequency generator configured to generate radio frequency for a time period and jaws mounted for movement with respect to one another, one of the jaws being coupled to the radio frequency generator, a method for controlling the area of a seal formed in a tube, said method comprising the steps of:

(a) selecting one of several predetermined settings each corresponding to an area of a seal; and (b) performing a tube sealing operation to form seal having an area corresponding to the selected setting.

33. A method of forming a tube seal in a tube sealing apparatus having first and second jaws operable between a first position spaced from one another and a second position selected to perform a successful tube operation, the method comprising the steps of:

(a) moving the jaws from the first position toward the second position;

(b) measuring a time delay when the jaws have moved toward the second position;

(c) comparing the time delay to a predetermined time limit; and (d) transmitting a signal that stops movement of the jaws under one of the following conditions:

i. if the time delay measured when the jaws have moved to the second position corresponds to a value up to the predetermined time limit; or ii. if the time delay measured before the jaws have moved to the second position corresponds to a value exceeding the predetermined time limit.

34. The method according to claim 33, further comprising the step of adding a completed tube seal count when the jaws have moved to the second position if the time delay measured when the jaws have moved to the second position corresponds to a value up to the predetermined time limit.

35. The method according to claim 34, further comprising the step of storing the completed tube seal count in a memory.

36. The method according to claim 33, further comprising the step of adding a failed tube seal count if the time delay measured before the jaws have moved to the second position corresponds to the value exceeding the predetermined time limit before the jaws have moved into the second position.

37. The method according to claim 36, further comprising the step of storing the failed tube seal count in a memory.

38. The method according to claim 33, further comprising the step of adjusting the predetermined time limit, thereby controlling an area of the seal formed in the tube.

39. A tube apparatus comprising:

jaws mounted for movement with respect to one another between (1) a first position spaced from one another and (2) a second position selected to perform a successful tube operation;

a first sensor;

a second sensor positioned to detect when said jaws have moved into said second position;

a controller electrically coupled to the first sensor and the second sensor and configured to start movement of the jaws upon receipt of a signal from the first sensor and to stop movement of the jaws upon receipt of a signal from the second sensor; and a timer electrically coupled to said second sensor for determining the time delay before the jaws have moved into said second position, wherein a time delay up to a predetermined time limit indicates a successful tube operation and a time delay exceeding the predetermined limit indicates a failed tube operation.

40. A tube apparatus adapted to detect successful or failed tube operations, said tube apparatus comprising:

jaws mounted for movement with respect to one another between (1) a first position spaced from one another and (2) a second position selected to perform a successful tube operation;

a sensor positioned to detect when said jaws have moved into said second position; and a controller electrically coupled to the sensor and configured to stop movement of the jaws when the sensor senses that the jaws have moved into the second position.

* * * * *